US010709949B2

(12) United States Patent
Wicoff

(10) Patent No.: US 10,709,949 B2
(45) Date of Patent: Jul. 14, 2020

(54) GOLF SWING TRAINING DEVICE AND METHOD

(71) Applicant: Erika Wicoff, Fishers, IN (US)

(72) Inventor: Erika Wicoff, Fishers, IN (US)

( * ) Notice: Subject to any disclaimer, the term of this patent is extended or adjusted under 35 U.S.C. 154(b) by 0 days.

(21) Appl. No.: 16/234,802

(22) Filed: Dec. 28, 2018

(65) Prior Publication Data

US 2019/0201767 A1 Jul. 4, 2019

Related U.S. Application Data

(60) Provisional application No. 62/611,868, filed on Dec. 29, 2017.

(51) Int. Cl.

| | |
|---|---|
| ***A63B 69/36*** | (2006.01) |
| ***A63B 69/00*** | (2006.01) |
| ***A63B 1/00*** | (2006.01) |
| *A63B 102/32* | (2015.01) |

(52) U.S. Cl.

CPC ..... *A63B 69/0059* (2013.01); *A63B 1/00* (2013.01); *A63B 2102/32* (2015.10); *A63B 2209/10* (2013.01)

(58) Field of Classification Search

CPC ..... A63B 69/0059; A63B 2209/10; A63B 2102/32

USPC ..... 473/207, 212, 214, 447, 448, 450, 409

See application file for complete search history.

(56) References Cited

U.S. PATENT DOCUMENTS 802,623 A * 10/1905 Camp
2,626,394 A * 1/1953 Davis ..... A41D 13/065 2/24
3,658,345 A * 4/1972 Siggson ..... A63B 69/0059 473/214
3,900,199 A * 8/1975 McGonagle ..... A63B 69/0059 473/214
3,937,218 A * 2/1976 Gaylord, Jr. ..... A41D 13/0568 128/892
3,975,015 A * 8/1976 Owens ..... A63B 71/08 473/63
4,048,674 A * 9/1977 Chesnick ..... A41D 13/08 2/16
4,254,766 A * 3/1981 Kordis ..... A61F 5/05866 128/877
4,254,953 A * 3/1981 Marchetti ..... A61F 5/013 473/214
4,489,716 A * 12/1984 Blackwood ..... A61F 5/373 602/20

(Continued)

OTHER PUBLICATIONS

Breg HEX Adjustable Hinged Elbow Brace (Large), Amazon.com Dec. 27, 2018.

*Primary Examiner* — Nini F Legesse

(74) *Attorney, Agent, or Firm* — Overhauser Law Offices, LLC

(57) ABSTRACT

A golf swing training device and method for preventing hyperextension of a joint during golf, or any other activity in which hyperextension occurs. The device includes a curved elongate member, which contains a bend that coincides with the joint, attached below the user's elbow using any one or more straps, cam buckles, and hooks and loops fasteners. The elongate member, when worn properly, does not allow the elbow to hyperextend as the top portion of the elongate member hits the back of the user's arm when the arm is straightened, preventing any further movement.

5 Claims, 14 Drawing Sheets

(56) References Cited

U.S. PATENT DOCUMENTS

| | | | | | |
|---|---|---|---|---|---|
| 4,605,227 | A * | 8/1986 | Hurd | A63B 69/0046 | 403/104 |
| 4,911,728 | A * | 3/1990 | Rigel | A63B 65/00 | 473/214 |
| 4,953,569 | A * | 9/1990 | Lonardo | A61F 13/102 | 128/889 |
| 5,445,385 | A * | 8/1995 | Brooks | A63B 69/0059 | 473/214 |
| 5,472,206 | A * | 12/1995 | Manley | A63B 69/0059 | 128/881 |
| 5,800,371 | A * | 9/1998 | Winn | A61F 5/3715 | 473/207 |
| 7,163,464 | B2 * | 1/2007 | McKeon | A63B 69/0059 | 473/217 |
| 7,658,681 | B1 * | 2/2010 | Malecha | A63B 69/3608 | 473/214 |
| 7,775,898 | B1 * | 8/2010 | Allen | A63B 69/0059 | 473/207 |
| 2006/0172812 | A1 * | 8/2006 | Kraus | A63B 69/3608 | 473/212 |
| 2014/0130310 | A1 * | 5/2014 | Roth | B60P 7/0846 | 24/306 |
| 2014/0171212 | A1 * | 6/2014 | Curry | A63B 69/0059 | 473/214 |

* cited by examiner

GOLF SWING TRAINING DEVICE AND METHOD

CROSS REFERENCE TO RELATED APPLICATIONS

This application claims the benefit of U.S. Provisional Application 62/611,868 filed 29 Dec. 2017.

FIELD OF THE INVENTION

The present invention relates to golf training devices and methods, and in particular to devices and methods to prevent a golfer from hyperextending the leading arm during a golf swing.

BACKGROUND

The majority of junior golfers, most adult women and even a percentage of adult men, can hyperextend, or "lock out", their lead elbow (e.g., left arm if swinging right handed). This often results from increased joint mobility. When a golfer is told to 'keep lead arm straight,' they have the ability to hyperextend their lead elbow, and as a result, lock out their lead shoulder. This hyperextended and locked out lead arm at address position then follows an almost identical swing path that is almost unfixable until the lead arm/shoulder is "unlocked" and free to move. This hyperextension prevents a good rotation of the arms and core (chest) in the backswing. The lead shoulder is literally locked in a position that prevents extension and rotation of the arm. When a player "locks out," the lead arm's humerus bone rotates up and into the shoulder and therefore limits the lead shoulder's mobility for the duration of the swing. Most students "lock out" at the address or beginning, of the swing, while others "lock out" in the downswing just prior to impact. Once "locked" at address, several consistent swing-error moves are made to get the club to "parallel" (Uneven hips, "shut clubface", straight trail leg . . . just to name a few). When "locked out" on the downswing, the lead shoulder/lead arm is prohibited, must lift/rise and compress against the clavicle/chest and shoulder blade as the lead arm is prevented from swinging down the target line, so the club is swung "left" of the target line. Poor, inconsistent shots are hit. The most detrimental aspect of this hyperextension is pain in the shoulder, neck, back and/or wrist. In some cases, pain becomes so chronic that extreme measures must be taken, such as administering nerve block to the affected area or even surgery.

A 2016 Study reports that Millennial men have lost 19 lbs. of grip pressure and Millennial girls have lost 11 lbs. compared to the same genders 30 years ago. https://www-.washingtonpost.com/news/wonk/wp/2016/08/15/todays-men-are-nowhere-near-as-strong-as-their-dads-were-researchers-say/?utm_term=.3298977c2215 and http://www.jhandtherapy.org/article/S0894-1130(15)00212-4/fulltext With a propensity for a weaker grip and extreme flexibility, the "lock out" elbow phenomenon is also present in other sports like softball, baseball, archery, etc. Accordingly, the present invention can assist players of other sports as well, and can also be adapted to prevent hyperextension of other the joints of other limbs, such as knees.

BRIEF DESCRIPTION OF THE DRAWINGS

In FIG. 1, the left shoulder is almost "pointed" in comparison to the "rounded" left shoulder in FIG. 2.

Notice the difference in the width and look of the left shoulders. In FIG. 3; the left shoulder is "pinched," while in FIG. 4 it has a more "rounded", "fuller" shoulder.

Notice the difference in the two left shoulders in FIGS. 5 and 6. In FIG. 5, the left shoulder is raised, behind the head and above the left ear. In FIG. 6, the left shoulder is lower than the left ear and away from the head.

Figure 1:
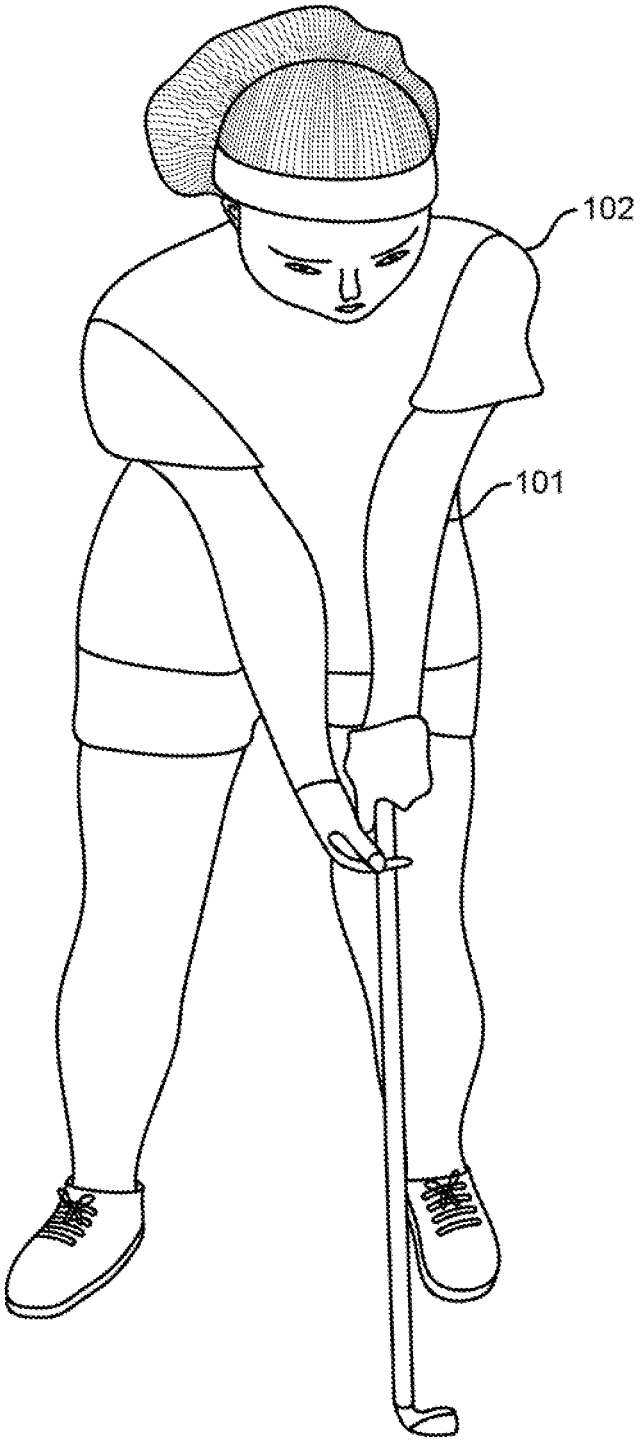
FIG. 1 shows a hyperextended or "locked out" left elbow address/starting position. Notice how the back of the left elbow is turned inward toward her side.
Figure 2:
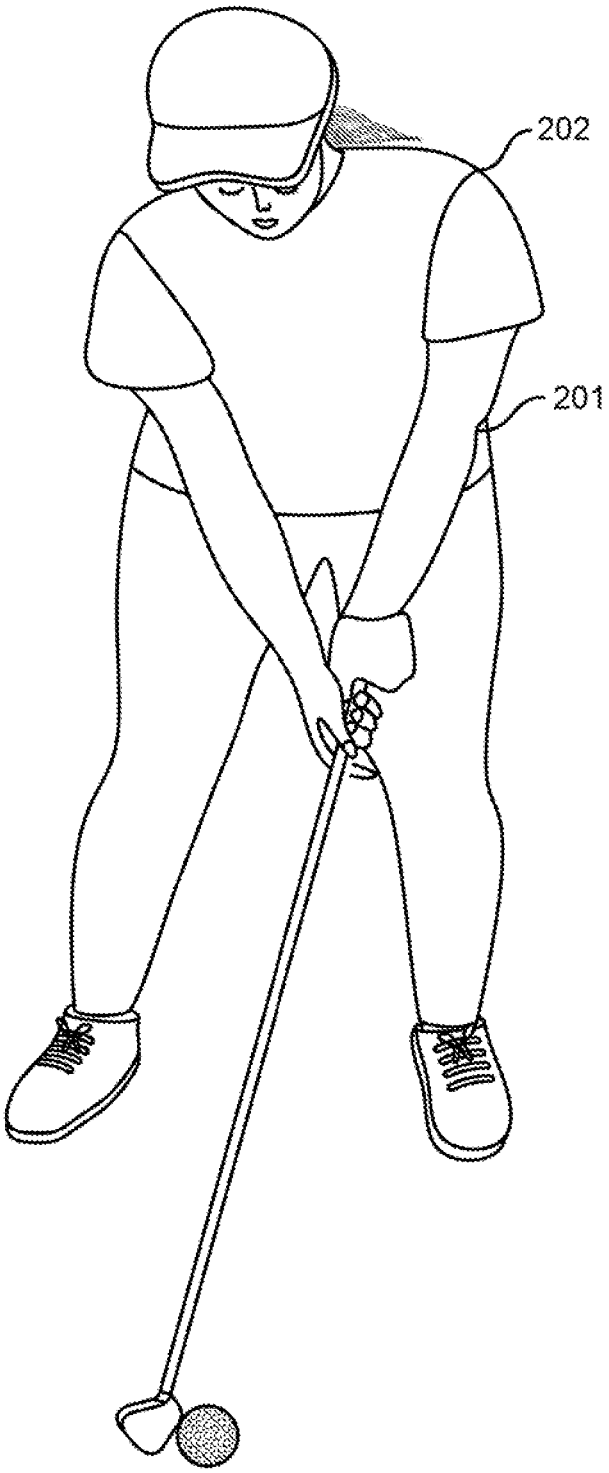
FIG. 2 shows a correct elbow position at address. Notice how the back of the left elbow is pointed away from her and almost toward the desired target. Also notice the difference in the left shoulders as compared to FIG. 1.
Figure 3:
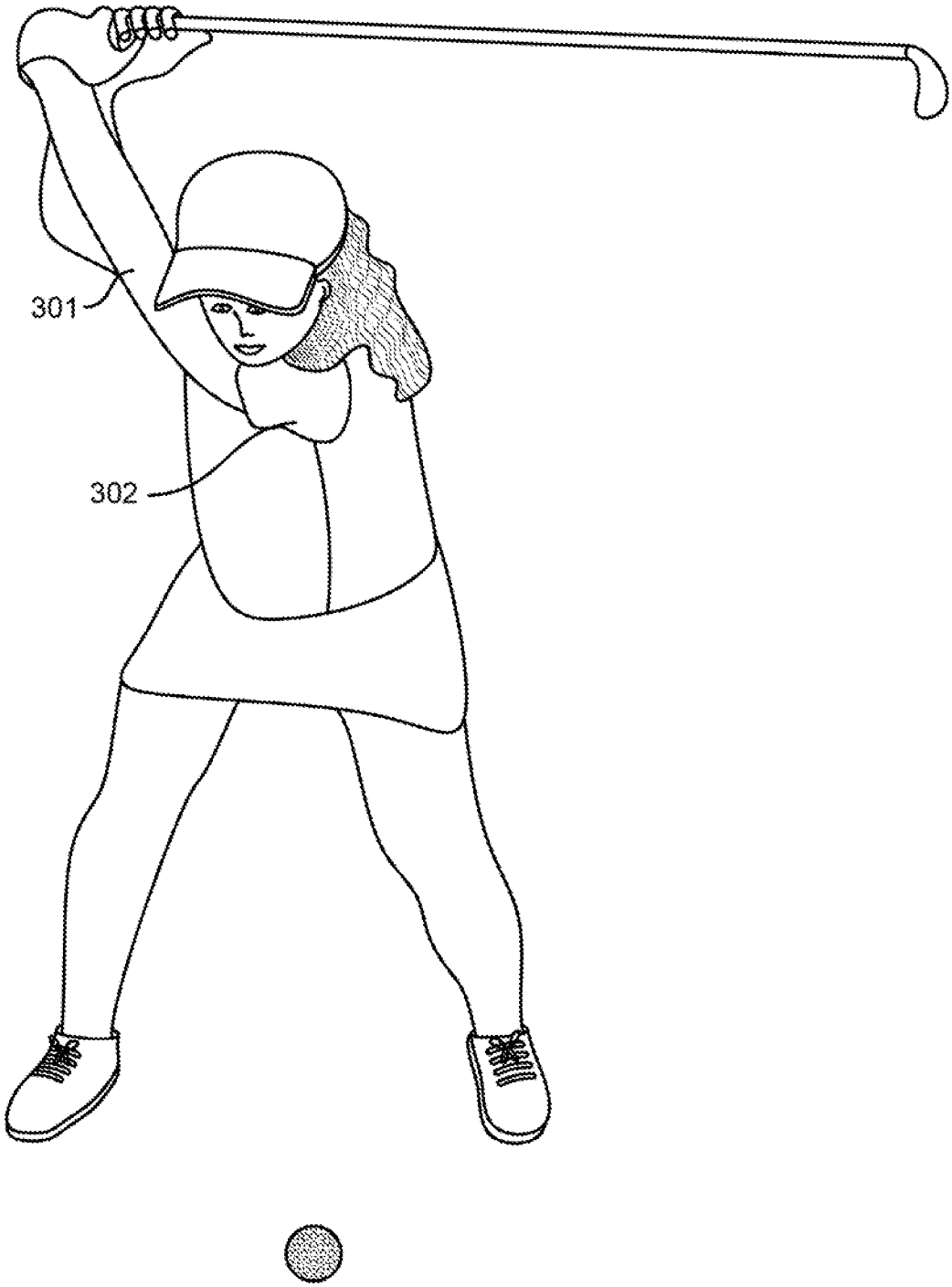
FIG. 3 shows the left elbow hyperextended at the top of the backswing and therefore prohibiting the ability of the shoulder to rotate and move properly.
Figure 4:
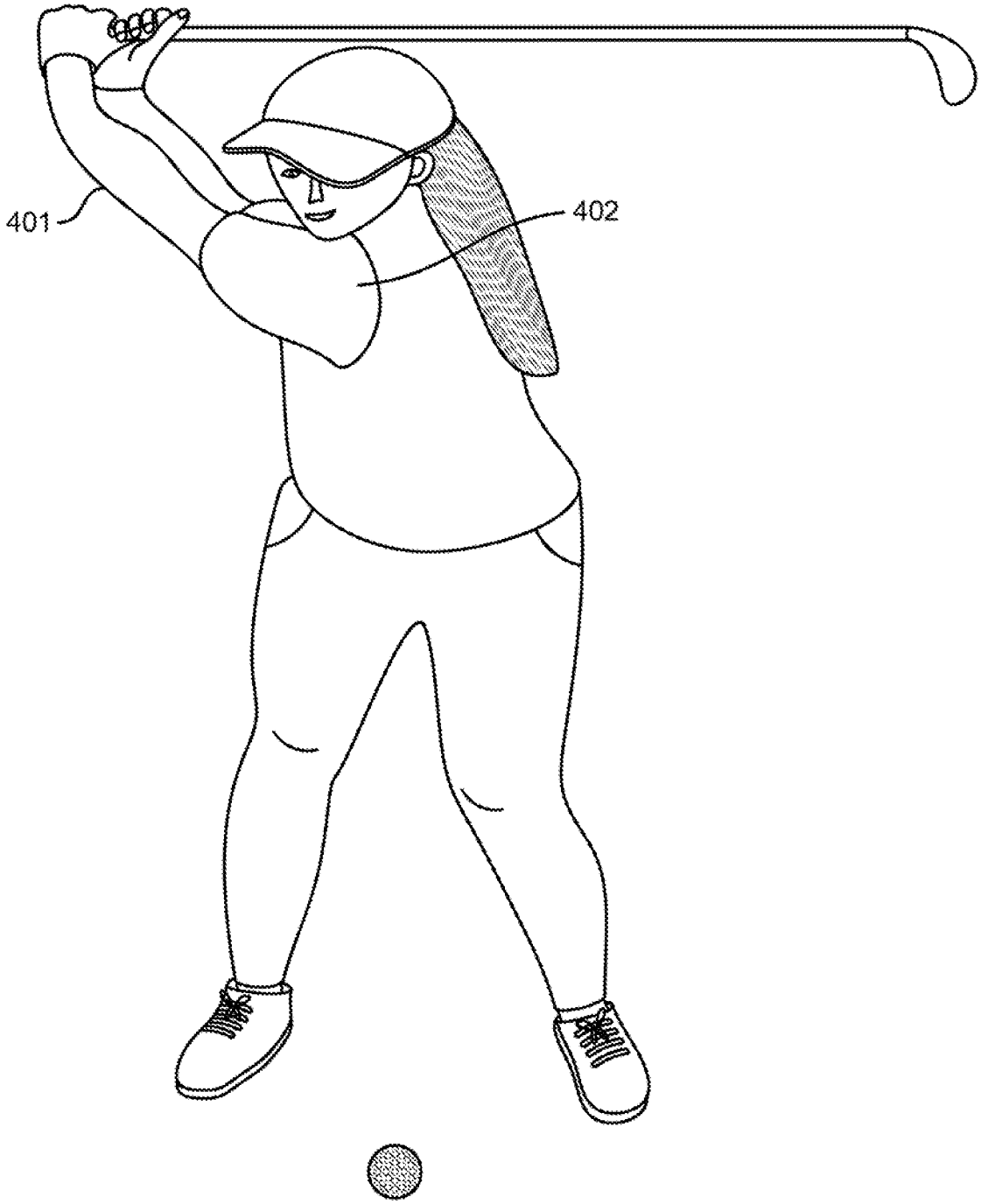
FIG. 4 shows a good position at the top of the backswing. The left elbow is slightly bent (not hyperextended). The shoulder is able to turn and move for better extension.
Figure 5:
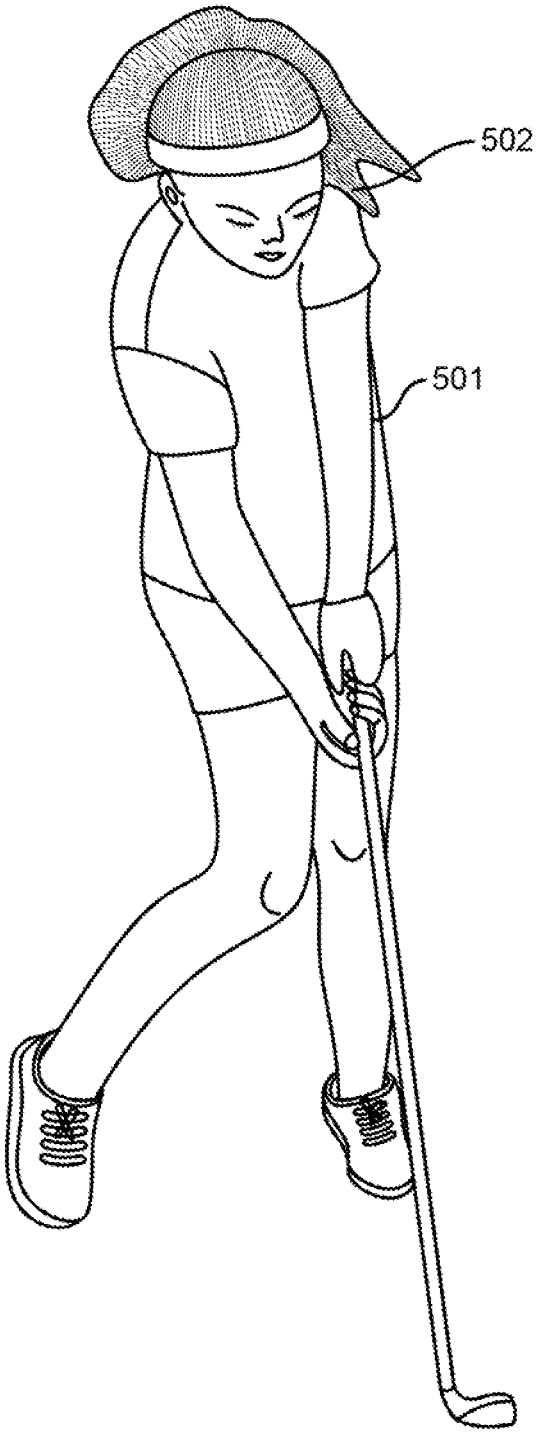
FIG. 5 shows a hyperextended left elbow at impact. The left shoulder is prohibited from moving and allowing arms to swing away from the body.
Figure 6:
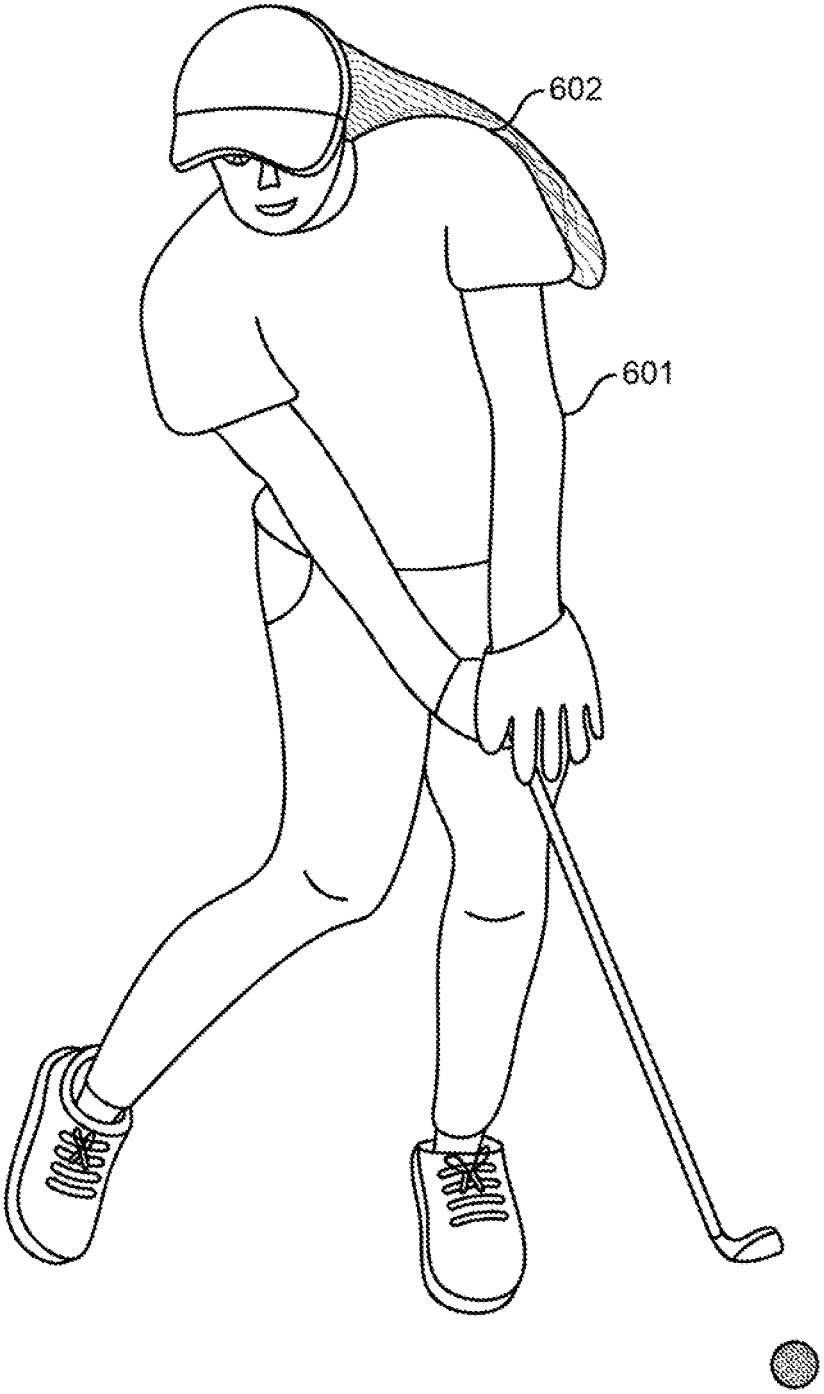
FIG. 6 shows the correct left elbow position at impact. The left arm is straight, not hyperextended, and the left shoulder is allowed to move and the arms are able to swing away from the body.
Figure 7:
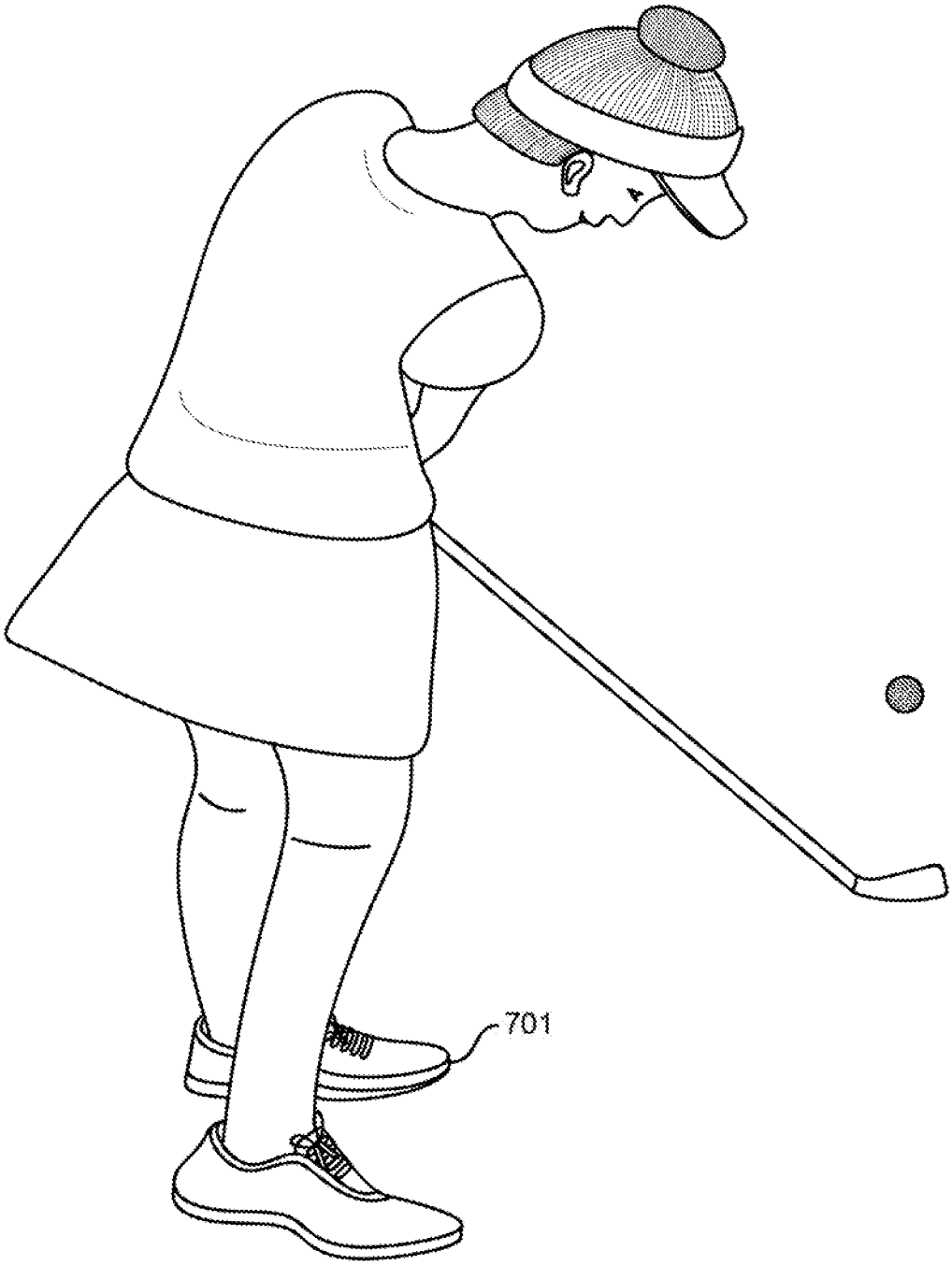
FIG. 7 shows a hyperextended left elbow past impact, forcing the hands to swing 'left', therefore left of the target/ball line. Due to the swinging left, much weight must remain on the right side, limiting distance and power.
Figure 8:
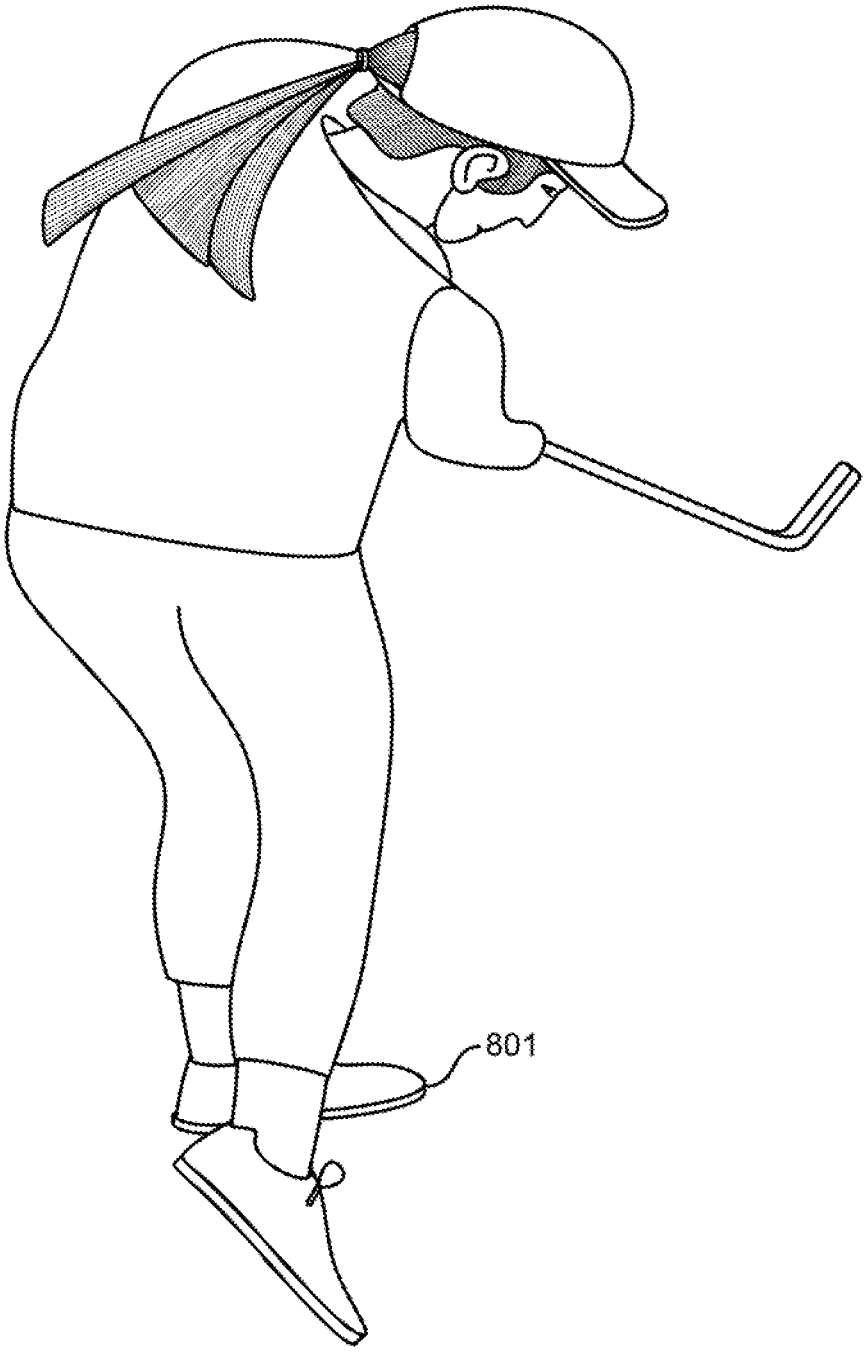
FIG. 8 shows a correct left elbow past impact. The hands/arms are able to swing away from the body and along the target/ball line. Notice the club face is open to the swing path also limiting distance and creating high, right shots.

As compared to FIG. 7, in FIG. 8 more weight is shifted onto the left foot, which improves power and distance.

Figure 9:
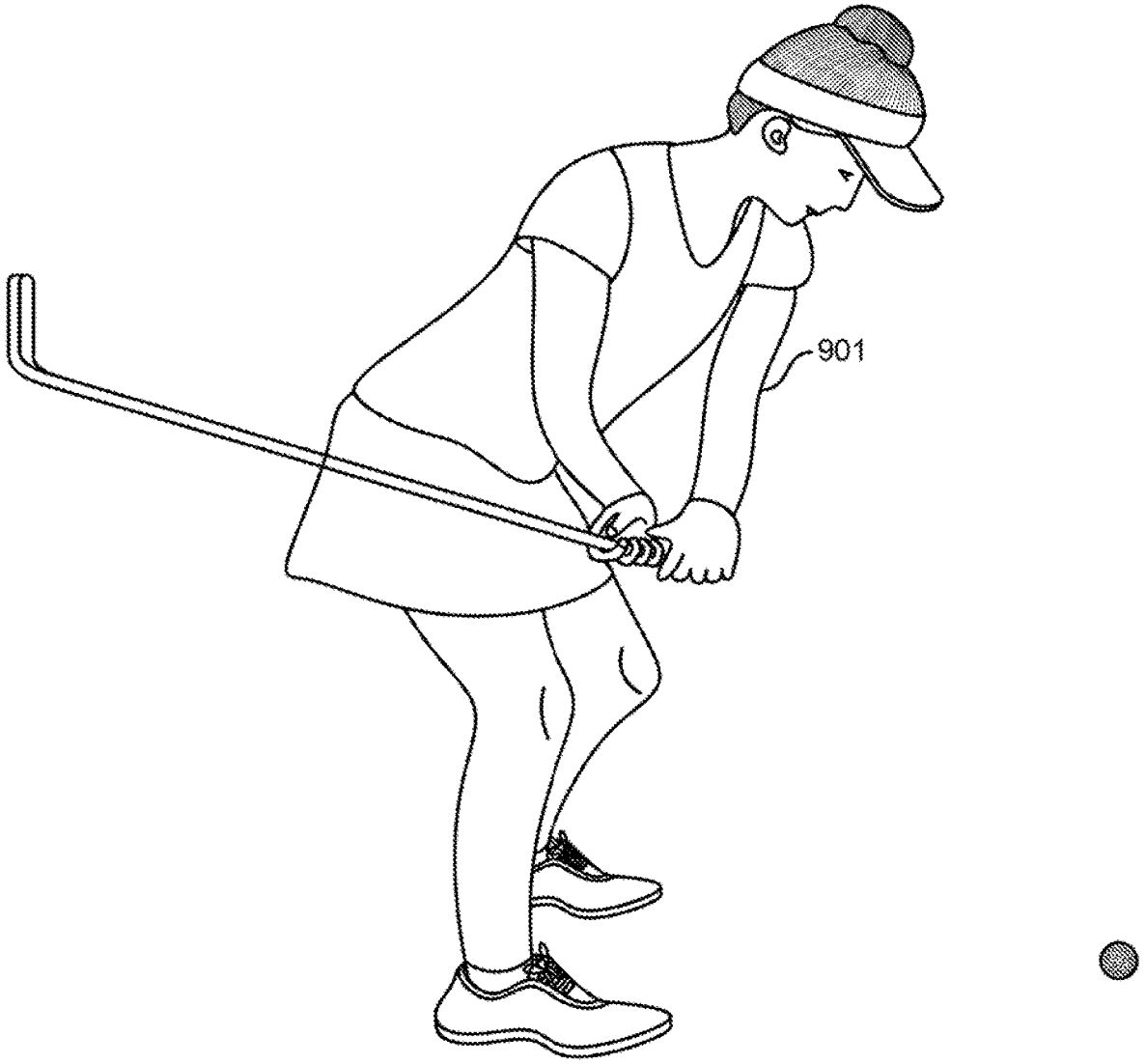

FIG. 9 shows a hyperextended left elbow in the downswing, prior to impact. The club is far behind the player. This is a "flat" position and prevents consistent shots. This is not "on plane," which is not desired.

Figure 10:
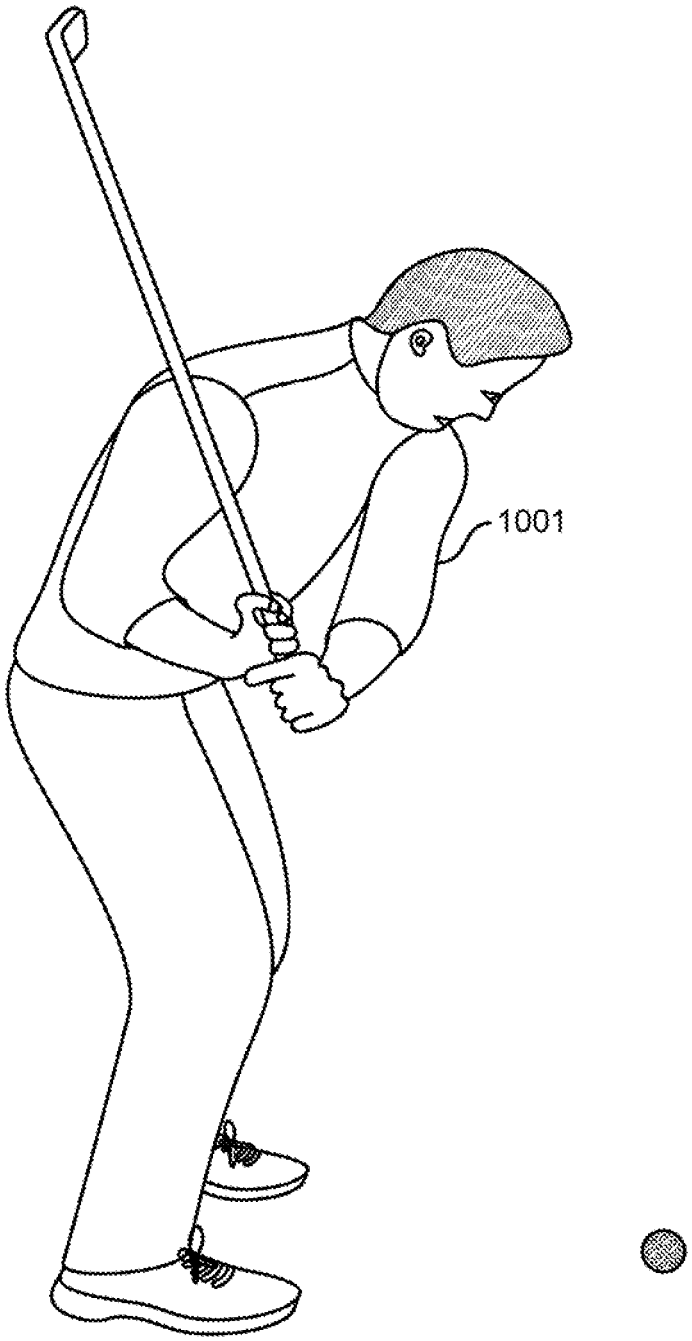

FIG. 10 shows a good left elbow in the downswing, prior to impact. It is not hyperextended and allows the shoulder and arms to move faster to impact. The club is closer to vertical, which permits better compression of the ball at impact. This is "on plane, which is desirable.

Figure 11A:
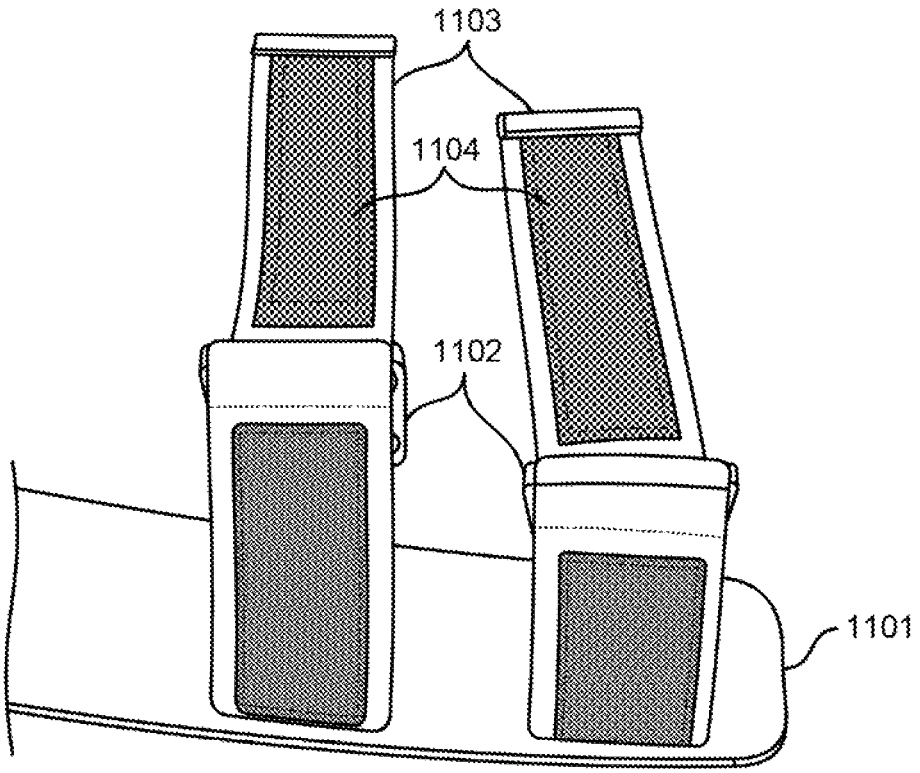
Figure 11B:
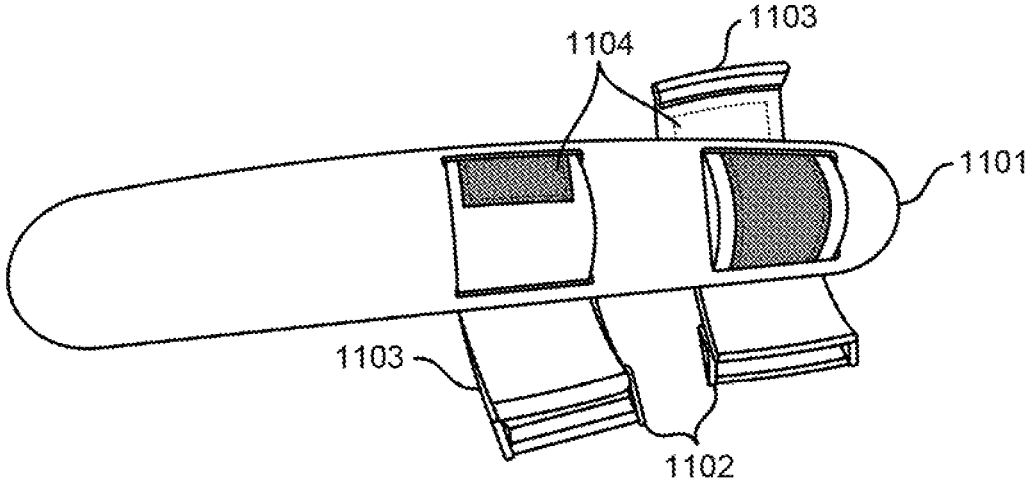

FIGS. 11*a* and 11*b* show an elongate member 1101 in accordance with the present invention having two cam buckles 1102 and straps 1103, with hooks and loops fasteners 1104 (Velcro) on the straps to securely hold the elongate member to the user's arm.

Figure 12:
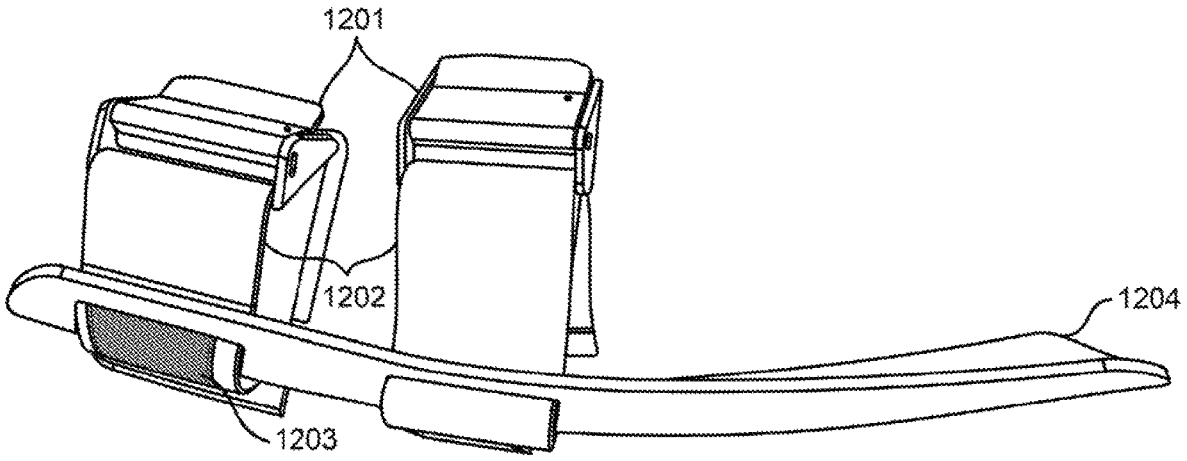

FIG. 12 shows a partial side view of the present invention having two cam buckles 1201 and straps 1202, with hooks and loops fasteners (Velcro) 1203 on the straps to securely hold the elongate member 1204 to the user's arm.

Figure 13:
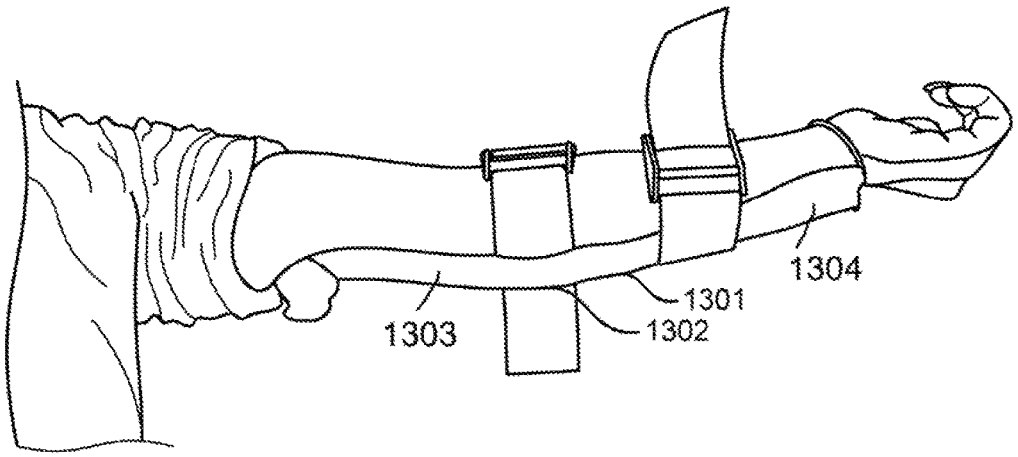

FIG. 13 shows one embodiment of the invention attached to an arm so that the curved, concave surface of the elongate member cradles (abuts) the top of the arm, and the bend is positioned at the elbow. In this view, the arm is twisted so that the "top" of the arm is toward the top of picture.

Figure 14:
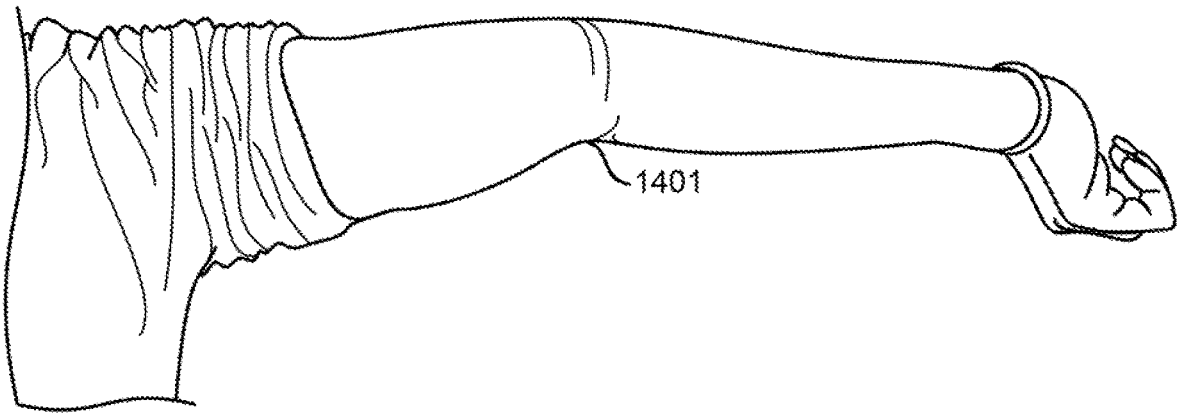

By way of comparison, FIG. 14 shows the same arm of FIG. 13 in a hyperextended position.

Figure 15:
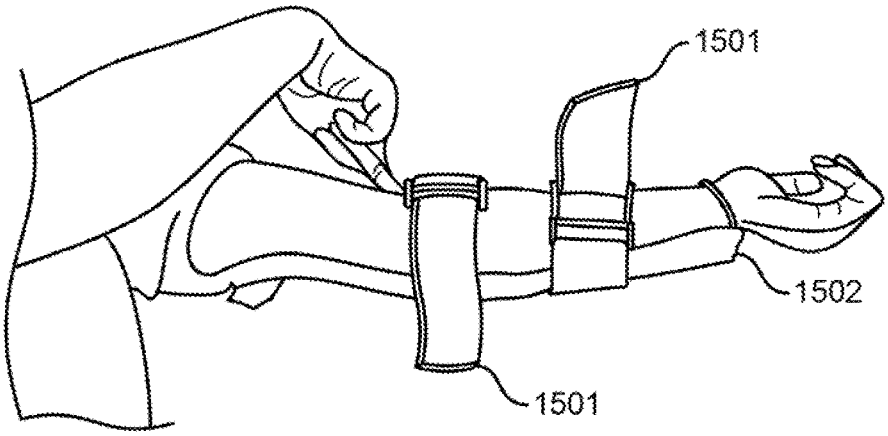

FIG. 15 includes a finger pointing to the user's elbow, and shows how the two straps attach the elongate member to the lower portion of the arm. In this configuration, the user is able to bend the elbow, which will cause the upper arm to be spaced from the elongate member, while the lower arm will continue to abut the lower arm.

Figure 16:
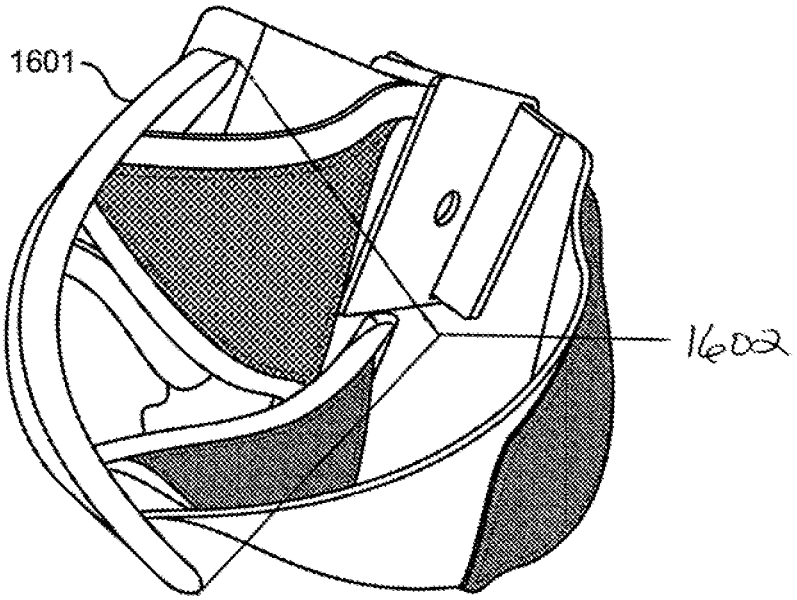

FIG. 16 is an end view of the distal end of the elongate member showing its curvature.

Figure 17:
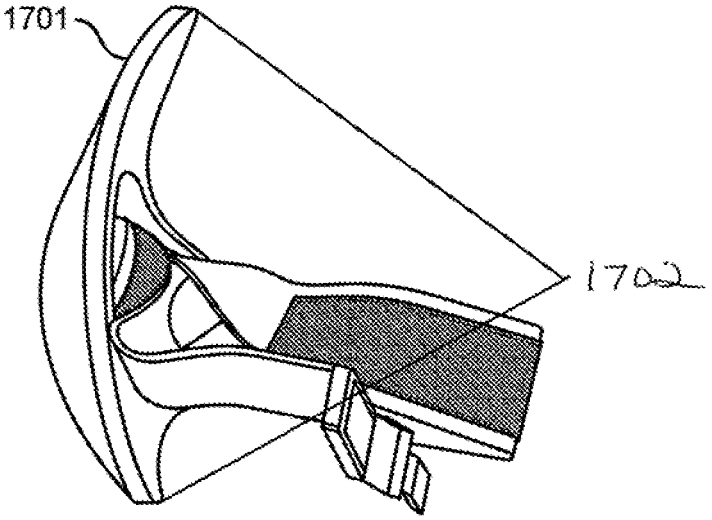

FIG. 17 is an end view of the end of the elongate member that is closer to the armpit of the user when worn, and showing its curvature.

SUMMARY OF THE INVENTION

Disclosed is a device and method for 'unlocking,' or preventing hyperextension of, the lead arm through the entire swing. This allows for better turn of the arms and core. It also allows the shoulder to function properly and the player can swing the golf club "out" away from the body and along the target/ball line. The shoulder and lead arm can relax and not push up into the chest/clavicle and shoulder blade in the downswing and through impact, but turn and "clear" out of the way for even better extension and club head speed, equating to more distance and increased consistency in shot performance. Preventing the lead arm "lock out" reduces pain and discomfort, decreases the risk of injury and gives a golfer more playing longevity.

The disclosed system and method allows the player to feel what it is like to not hyperextend during the swing. The device is designed with a slight bend, which may be approximately 18°, to prohibit hyperextension. If a player attempts to hyperextend, the top (shoulder end) of the device will hit the upper arm, preventing extension past 18°. The long extension at the top (shoulder end) prevents the player from locking the elbow in any part of the swing. The system allows the player to rotate the forearms and the wrists through impact as they feel swinging down the target line uninhibited. The lead shoulder can turn and "clear" out of the way (as opposed to rising) and maintain movement with the shoulder blade. These are new sensations felt by the players and the changes are seen with ball flight, immediately.

DETAILED DESCRIPTION

In one embodiment, the invention includes a curved, elongate rigid member with a slight bend 1101. The rigid member has an upper portion adapted to abut the back of an upper arm 1701, and a lower portion adapted to abut the back of a lower arm 1601. The bend 1302 is intermediate the upper 1303 and lower 1304 portions. The lower portion includes means to retain it against the back of a lower forearm, such as one or more adjustable straps 1103. When strapped to the back (or top) of a forearm, the rigidity of the elongate member prevents hyperextension of the elbow FIG. 15.

In one embodiment, the elongate member 1101 is 15.5" long and 4" wide at the top (shoulder end) 1701 and 3.75" wide at the bottom (wrist end) 1601. It is made of a solid, durable, inflexible material, such as fiberglass. The length is curved slightly to 'cradle' or abut the back (top) of the lead arm. Two 2" straps 1103 fasten the elongate member to the bottom end to the forearm, and may be adjusted for the player. The straps 1103 may be attached to the device with a fabric sleeve over the elongate member. The elongate member is applied to the 'outside' or back of the lead arm with the bend in the elbow matching the 'bend' 1302 in the elongate member 1101. The straps may be secured tightly against the forearm, just below the elbow and above the wrist FIG. 13. Attaching the elongate member 1101 to only the forearms allows the elbow to naturally bend after impact.

With the 18° bend in the elongate member 1101 and the straps 1103 tightly secured just below the elbow and above the wrist, the elongate member 1101 prevents the elbow from hyperextending because the part of the elongate member above the elbow 1701 hits the upper arm, and stops further straightening of the arm. The system prevents injury, improves the golf swing, and assists in any sport in which hyperextension of a joint is a concern.

FIG. 16 is an end view of the distal end of the elongate member showing its curvature. The radius of the distal end is represented by the two lines which converge at 1602.

FIG. 17 is an end view of the end of the elongate member that is closer to the armpit of the user when worn, and showing its curvature. The radius of this end is represented by the two lines which converge at 1702, and is greater than the radius at the distal end shown in FIG. 16. This reflects the fact that the part of a person's arm closer to the armpit has a greater diameter than the part closer to the wrist.

The size can be varied to accommodate the arm size of the user.

The above dimensions have been found to suitable for players 5'3" to 6'0". A larger or smaller size may be made to more closely match the length and contour of the user's arm.

While the invention has been illustrated and described in detail in the foregoing drawings and description, the same is to be considered as illustrative and not restrictive in character, it being understood that only illustrative embodiments thereof have been shown and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A method for preventing hyperextension of an arm comprising:

providing a rigid one-piece elongate member, having an upper portion, a lower portion, and an elbow-engaging portion intermediate the upper and lower portions, the elbow-engaging portion having a bend of 15° to 21°, means for affixing the lower portion of the elongate member to a forearm of a person, said means comprising:

a first pair of slots through which a first strap passes, a second pair of slots through which a second strap passes;

affixing the lower portion of the elongate member to the forearm of the person by securing the first strap through the first pair of slots lust above the person's wrist and securing the second strap through the second pair of slots just below the person's elbow so that:

the lower portion is flush with the forearm of the person, the elbow-engaging portion of the elongate member is coincident with and abutting the back of the elbow of the person, and the upper portion of the elongate member is not fixed to the upper arm of the person;

swinging the arm in a manner consistent with a golf swing such that the upper portion of the elongate member hits the upper arm and stops further straightening of the arm;

such that the ridgis member prevents hyperextension of the arm of the person.

2. The method of claim 1 wherein the elongate member comprises polyurethane.

3. The method of claim 1 wherein the upper portion of the elongate member is curved in a manner in which the radius of the curve defined by the end of the upper portion has a larger radius than the curve defined by the end of the lower portion of the elongate member.

4. The method of claim 1 wherein the means for affixing the straps comprises hooks and loops fasteners on the first and second straps whereby each strap may be affixed to itself, and wherein the step of affixing the lower portion of the elongate member to a lower portion of an arm of the person comprises engaging the hooks and loops fasteners on each strap to each other.

5. The method of claim 1 wherein the means for affixing further comprises a cam buckle.

* * * * *